US007935295B2

(12) United States Patent
McGourlay

(10) Patent No.: US 7,935,295 B2
(45) Date of Patent: May 3, 2011

(54) CORE LEACHING

(75) Inventor: Jamie C McGourlay, Derby (GB)

(73) Assignee: Rolls Royce, PLC, London (GB)

( * ) Notice: Subject to any disclaimer, the term of this patent is extended or adjusted under 35 U.S.C. 154(b) by 911 days.

(21) Appl. No.: 11/367,505

(22) Filed: Mar. 6, 2006

(65) Prior Publication Data

US 2006/0219664 A1 Oct. 5, 2006

(30) Foreign Application Priority Data

Apr. 5, 2005 (GB) ..... 0506834.1

(51) Int. Cl.
*B29C 71/00* (2006.01)

(52) U.S. Cl. ..... 264/344; 264/DIG. 44; 425/DIG. 12

(58) Field of Classification Search . 216/9; 156/345.11; 264/344, DIG. 44; 425/DIG. 12
See application file for complete search history.

(56) References Cited

U.S. PATENT DOCUMENTS

| | | | | |
|---|---|---|---|---|
| 3,661,660 | A * | 5/1972 | Wessells et al. | 430/309 |
| 4,162,173 | A | 7/1979 | Arendt et al. | |
| 5,080,839 | A * | 1/1992 | Kindt-Larsen | 264/2.6 |
| 5,262,100 | A | 11/1993 | Moore et al. | |
| 5,401,379 | A | 3/1995 | Mazzochi | |
| 6,136,724 | A * | 10/2000 | Hansen et al. | 438/745 |
| 2002/0066470 | A1 * | 6/2002 | Farr et al. | 134/10 |
| 2004/0003909 | A1 * | 1/2004 | Schlienger et al. | 164/132 |
| 2004/0195713 | A1 | 10/2004 | Hansel | |
| 2005/0092433 | A1 * | 5/2005 | Doh | 156/345.11 |

FOREIGN PATENT DOCUMENTS

| | | |
|---|---|---|
| GB | 404972 | 1/1934 |
| GB | 806479 | 12/1958 |
| GB | 831998 | 4/1960 |
| GB | 1 260 271 | 1/1972 |
| WO | WO 03/086686 A1 | 10/2003 |

* cited by examiner

*Primary Examiner* — Yogendra N Gupta
*Assistant Examiner* — Alison Hindenlang
(74) *Attorney, Agent, or Firm* — Oliff & Berridge, PLC

(57) ABSTRACT

Removal of a soluble part of a core allows provision of relatively complex three-dimensional geometric shapes in a component. Unfortunately previous leaching arrangements have been relatively erratic such that it is difficult to provide consistency of component form over a batch of components formed. By providing a tank combination which comprises typically a number of dip tanks, it is possible to provide consistency in terms of leach solution efficiency upon cores. Generally leaching solution held within the tanks is adjusted through either a prior calibrating adjustment tank or through agitation or other means in the tank such that the effects of saturation ageing of the leaching solution can be homogenised across all cores subject to the leaching process.

11 Claims, 1 Drawing Sheet

CORE LEACHING

The present invention relates to core leaching and more particularly to leaching of cores in order to remove soluble portions of the core to create components with three dimensional geometries.

Core leaching processes allow the effective removal of a soluble part from an insoluble part of a core which has been fused together via injection moulding techniques earlier in the component formation process. Removal of the soluble part allows the creation of complex three-dimensional geometries which would be otherwise unobtainable via conventional injection moulding processes. The process is similar to a lost wax process but utilising a leach erosion process to remove the soluble part rather than liquefy the wax through heating.

Previously, the leaching process involved a single tank of room temperature, still, leaching fluid into which the fused soluble/insoluble core was submersed and if required manipulated by hand until the leaching (i.e. dissolution and removal of the soluble part) had been achieved as determined by a visual inspection of the unleached part surface for soluble material residue. Subsequent parts were then leached in the same way until it was determined that the leaching fluid had become saturated, that is to say the reactive chemical content is exhausted and aged.

In the above circumstances, it will be appreciated that essentially prior core leaching processes were of a manual nature. Thus, these processes had no accurate or adjustable control on the rate of soluble part removed or of critical leaching process parameters that are key to the quality control of the final component product. Additionally it required laborious and irregular replacement of the leaching fluid once saturated. Furthermore, the approach is not readily scaleable to accommodate increased volumes associated with larger scale part component production.

In view of the above, it will be appreciated that the wide scale use of core leaching processes in component production is inhibited by the difficulties with respect to large scale manufacture as well as the potential irregularities between the manual manipulation processes for prior leaching processes as well as variations in the efficiency of the leaching fluid as a vat or tank of leaching fluid iteratively becoming more saturated with each core leached.

In accordance with the present invention there is provided a core leaching arrangement for removal of a soluble part of a core, the arrangement comprising a tank combination to contain a volume of leaching fluid and the tank combination arranged to receive a number of cores, the arrangement characterised in that the tank combination includes adjustment means whereby the tank combination presents leaching fluid to each core for a desired rate of leach erosion of the soluble part of each core consistent or specifically varied over the number of cores received.

Also, in accordance with the present invention there is provided a method of leaching a core comprising providing a tank combination with a volume of leaching fluid in which a core can be dipped, the method characterised in that the leaching fluid is adjusted by adjustment means whereby the leaching fluid presented to each core is effectively calibrated for desired rate of leach erosion of the soluble part of each core consistently or specifically varied over the number of cores received.

Generally, the adjustment means provides for physical equalisation in the effectiveness or specifically desired variation in effectiveness of the leaching fluid upon a respective core.

Typically, the adjustment means comprises a plurality of dip tanks, each dip tank including an equal proportion of the leaching fluid and respective presentation of the cores to the plurality of dip tanks. Generally, the adjustment means is arranged to provide for presentation of one core to one tank with means to equalise or re-generate leaching fluid contained within a respective dip tank between presentations of a core. Alternatively, each core is moved from dip tank to dip tank in the tank combination. Possibly, each core is presented to all dip tanks in sequential succession across the tank combination. Alternatively, a core is presented to a specific group of dip tanks.

Possibly, the adjustment means comprises a heater to adjust the temperature of the leaching fluid. Generally, the adjustment of the temperature of the leaching fluid is to vary the relative leach erosion efficiency of the tank combination between cores of the number of cores presented to the tank combination. Possibly, the adjustment of the temperature of leaching fluid is to vary the effective leach erosion upon each core to compensate for leaching fluid saturation ageing.

Generally, the adjustment means will include means for agitation of the leaching fluid about a core. Possibly, such agitation comprises bubble generation agitation or a mechanical stirrer or ultrasonic agitation or spray jet presentation of the volume of leaching fluid to a core or core swishing within the tank combination.

Normally, the adjustment means includes a timer to vary the exposure of each core to leaching fluid.

Possibly, the tank combination includes a hanger for each core. Generally, the hanger is associated with the adjustment means to provide precise positioning of each core for consistent or specifically variable erosion of the soluble part of that core.

Possibly, the tank combination includes a pre adjustment tank for equalising the leaching fluid bulk for consistency in the tank combination. Generally, the pre adjustment tank includes a heater to ensure the leaching fluid bulk has a consistent temperature for use in the tank combination.

Normally, the tank combination includes a tap for removal of all or a selective proportion of the leaching fluid to allow ready replacement of that leaching fluid within the tank combination between successive cores of the number of cores or each number of cores presented to the tank combination in use.

Advantageously, the core leaching arrangement is also associated with a washing and air drying system such that in combination with the leaching arrangement there is rapid removal of the leaching solution residue. Typically, the air will be heated in order to further increase the speed of processing.

Embodiments of the present invention will now be described by way of example and with reference to the accompanying drawings in which.

It will be understood with any production process uniformity or control of the process in terms of consistent performance is an objective. As indicated above previously with respect to leach removal of soluble parts from a core, the variability with respect to saturation "ageing" of the leaching fluid or solution with successive operations on cores as well as variables such as hand manipulation of the core and exposure times means achieving uniformity is difficult. In such circumstances, in order to improve the acceptability of core leaching as a means for producing three-dimensional component geometries, it is necessary to provide an arrangement which provides more consistency in terms of the production process to allow more specific control of the eventual core structures created.

The approach taken with respect to the present invention utilises an arrangement in which a linear multi-tank, multi-stage process is used to facilitate sequential, rapid and continued leaching of soluble parts from insoluble parts as the injection moulding process manufactures them. Each dip tank has the same dimensions and holds the same amount of leaching fluid as delivered from a preheat tank. Thus, the volumes of leaching fluid are adjusted for consistency in each dip tank. Each dip tank is insulated and has its own heating and thermal control system to allow individual control of in tank leaching fluid temperature to a range and accuracy of 25-100° C. and +/−1° C. Additionally, each dip tank has its own fluid circulation/agitation system with an adjustable agitation rate to facilitate faster and more even removal of the soluble part from the core. Each dip tank incorporates a timer for adjustment control of batch to batch leaching fluid exposure times to a core. Each dip tank may also include a rail system to allow the hanging of parts to precise levels within the dip tank and in selected orientations. Each dip tank has its own tap supply connected directly to the pre-heat tank for pre adjustment of the leaching fluid bulk and a tank bottom drain to allow the rapid emptying and re-filling of the tank after the leaching fluid has become saturated, that is to say unacceptably aged. After this has happened, continued leaching can be maintained by use of the next, adjacent pre-prepared dip tank in the arrangement. The saturated, aged tank can then therefore be emptied and re-filled to continue the process cycle and to maintain process efficiency. Additionally if two or more stages are required in the leaching process, adjacent tanks can be run at independent settings to provide multi-staging via simple manual transfer of parts between the stages once the leach time for the previous stage has been completed.

Figure 1:
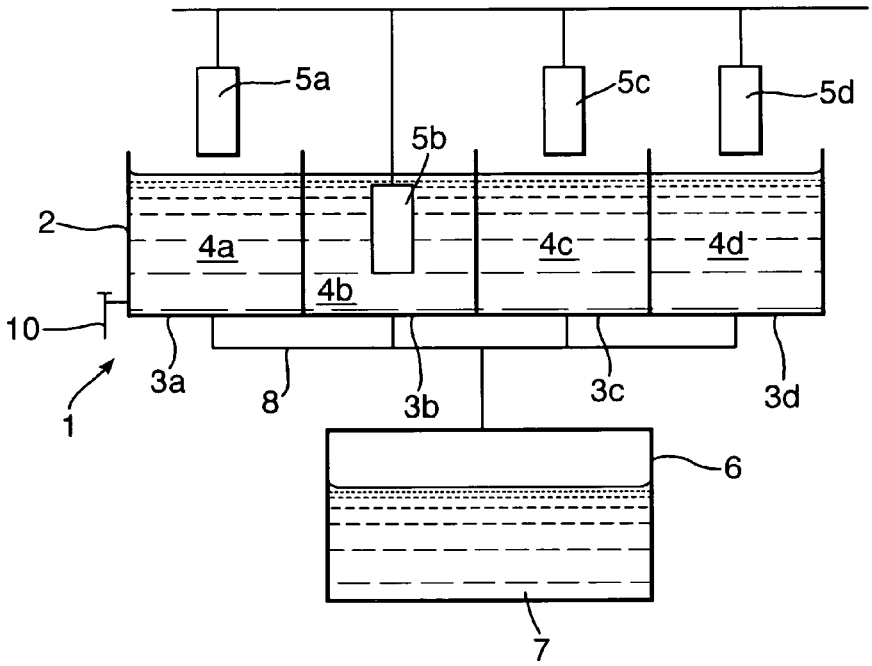
FIG. 1 is a schematic depiction of a core leaching arrangement in accordance with the present invention.

FIG. 1 provides a schematic illustration of the arrangement described above with regard to the present invention. Thus, the arrangement 1 comprises a tank combination 2 in which a number of dip tanks 3 are arranged to receive an equal volume of leaching fluid or solution 4 in order that cores 5 comprising a soluble part and an unsoluble part can be dipped and immersed in the leaching fluid 4. As indicated above, a rail may be provided in order to present the cores 5 to the fluid 4 appropriately. As illustrated, one core 5 may be presented at a time to a respective dip tank 3 and therefore its leaching fluid 4 or a group of cores presented at the same time. However, as described above, the objective is to provide consistency between leaching operations and one particular way of achieving that is the utilisation of the leaching fluid in one tank 3 until saturated or aged, and then whilst that tank and its leaching fluid 4 is re-generated, another tank 3 and its leaching fluid 4 is then utilised for leach erosion of the soluble part of the core in order to create the component structure required.

As indicated above, it is important that there is consistency between the leaching operation performed upon each core 5. There are a number of physical variables which may alter the efficiency of the leaching fluid including the temperature of that leaching fluid and the degree of homogenisation of the fluid in each dip tank 3. In such circumstances, in the arrangements shown in FIG. 1, it will be understood that means for adjustment and alteration of the leaching fluid to cause equalization between the leaching fluid 4 in each tank 3 will be provided.

The particular adjustment depicted in FIG. 1, although others as described later will also be generally used, is to provide a pre-adjustment tank 6. This pre-adjustment tank 6 acts upon a bulk volume of leaching fluid 7 in order to homogenise the temperature and possibly other factors which may be variable across the leaching fluid, particularly if still. In such circumstances the pre-adjustment tank 6 effectively "calibrates" the leaching fluid to a known leaching efficiency which can then be utilised in determining other factors with respect to the necessity for erosion of the soluble part of the cores 5 in the actual leaching process stages. Generally, the pre-adjustment tank 6 will elevate the temperature of the fluid 7 to a value in the range 25 to 100° C. with a bulk temperature accuracy of +/−1° C. In such circumstances, when the adjusted leaching fluid 7 is pumped by an appropriate distribution arrangement 8 to the tanks, there is consistency with respect to the leaching efficiency of that fluid for greater confidence as to the erosion performance upon the core 5 and therefore predictability and consistency with respect to the core geometry eventually provided by removal of the soluble part of the initially moulded core prior to dipping in the leaching fluid.

Generally, as described above, each dip tank 3 will incorporate a tap 9 (only shown with regard to dip tank 4*a*) and a drain 10 to allow rapid removal of saturated or exhausted leaching fluid 4*a* and replenishment with pre-adjusted leaching fluid 7 through the network 8 from the tank 6. In such circumstances, leaching process operators can be sure as to the leaching performance upon a core 5 over a number of such cores presented to the core leaching arrangement 1 in accordance with the present invention. The removed exhausted or aged leaching fluid may be disposed of or more normally regenerated in some way in order to allow that leaching fluid to then be re-used in the leaching process. Alternatively, the used leaching fluid may be filtrated for blending to a leaching consistency.

It will be appreciated that the whole arrangement in accordance with the present invention will generally be enclosed and associated with an appropriate environmental shielding system including an extraction arrangement to ensure that any noxious fumes are not released. This is particularly advantageous where there is close association between the actual arrangement 1 and the site for initial core injection moulding.

As indicated above, it is important that there is provision for substantial uniformity in the leach erosion process applied to each individual core of a batch. However, it may be desirable to provide specifically different leaching erosion to respective cores of a batch. This may be useful during initial development stages in order to determine the effects of the leach erosion process upon individual cores, otherwise uniformly formed in terms of their operational performance, durability and reproducibility. In such circumstances by provision of generally the calibrating benefit of a pre-adjustment tank 6 as well as consistent leaching effect with respect to the dip tanks 3 of the tank combination 2, it will be understood that it is possible to create the consistency of leaching erosion effect between all cores of a group batch or individually with respect to cores in that number of cores in a batch.

By use of a linear multi-stage, multi-tank arrangement it will be understood that independent stage to stage (tank to tank) control of leaching time, agitation and temperature setting is possible. This allows enhanced control of the unleached parts thermal environment and the rate of removal of soluble material during leaching. These parameters are key to the maintenance of a clean, soluble-residue free leached surface on the final leached part, which is critical to ensuring the final visual and dimensional quality of the finished part surface and even the integrity of the part's material strength. Additionally the ability to control the thermal environment of the unleached part directly after moulding ensures that any thermal contraction differences between soluble and insoluble materials in the unleached parts can be minimized and regulated. This could otherwise result in a catastrophic breakdown of the part geometry during the post moulding process. These parameters can be optimised for any particular part geometry and adjusted where required to suit alternative part geometries and ensure the final quality of the part.

The system also allows the unleached parts to be set in discrete orientations to give easier manual regulation of batch leaching times and transferal into and out of the leaching arrangement and between separate leaching tanks. This allows preferential removal of soluble material from specific areas first and in the case of certain part geometries, their controlled orientation in the leaching tanks combined with thermal environmental manipulation can regulate and even corrected for internal stress and strain deformities produced during the moulding process. In this way the specific control of part orientation and temperature during leaching critically control the final components dimensional quality.

The multi-tank system has the flexibility to allow the rapid start-up, emptying, and refill of any individual dip tank 3 during the leaching process to provide real-time and continuous leaching. Each dip tank 3 may have independent settings of leaching time, temperature, agitation and part orientation, different unleached part geometries can be incorporated in different tanks at the same time, and/or a successive multi-stage leaching for any particular part can be performed (i.e. similar to multi-stage scrubbing/polishing process.

Reproducibility as indicated above is a key element with respect to obtaining consistency with regard to the finally formed core comprising the undissolved parts of the initial moulded core. By utilisation of the present arrangement it will be understood that consistent batch processing of cores is more readily achieved. In short, the present arrangement comprises provision of a tank combination in which at least one dip tank is associated with adjustment means to vary the effect and efficiency of the leaching solution for consistency across all cores of a number of cores to be processed or by selective variation in that leaching solution efficiency and effect and ability to determine the effects of varying leaching processes upon the component product produced. The adjustment as indicated is generally of a physical nature in terms of temperature, agitation of the leaching fluid, maintaining the operational leaching fluid within a calibrated efficiency spectrum and otherwise achieving operational consistency in terms of washing and drying of the cores after leaching. Approaches to achieving this adjustment in addition to providing the pre-adjustment tank for calibration of the leaching solution are described later with regard to FIGS. 2 to 5. However, it will also be understood that by use of purified or alternative leaching fluids incorporating catalytic chemical reagents during leaching it may be possible to increase the rate of removal of the soluble material and/or the use of reagents which allow the soluble part once dissolved to be drawn off and reconstituted as a solid for physical/chemical scrubbing and filtration from the leaching arrangement. This process would serve to regulate the in-situ concentration of soluble material in the leaching fluid, controlling its removal rate and produce recycling of the leaching fluid and/or soluble material to improve continued system operation and/or reduce waste disposal.

Additionally, automation of the process is possible via a rail track or a carousel to facilitate the automated exposure of the unleached parts to the single/multi-stage tank leaching system with unleached parts placed or hung individually in stations with adjustable orientations and/or the use of part profile 'setters'. The timing of each parts exposure to the leaching solution could then be controlled either by the speed of the automated movement through the leaching process or via an alarmed timer associated with each dip tank.

The use of alternative means to direct flow/agitation of the leaching fluid relative to the soluble part would also result in improvements to the rate of soluble material removal and the control of the leaching erosion process. The automated system described above may incorporate an additional rotational/translational manipulation of the unleached part during transit in the leaching tanks to regulate this flow and agitation relative to the leaching fluid. Alternatively, manipulation of the leaching fluid flow/agitation could be produced by directed water jets, physical or sonic oscillation of the tank or its components, or via more conventional means such as bubble curtains, paddles, stirrers and propellers. A system using enclosed and directed spray-jets could also be employed as an alternative to leaching solution submersion, this again would reduce system operating time and waste disposal.

Figure 2:
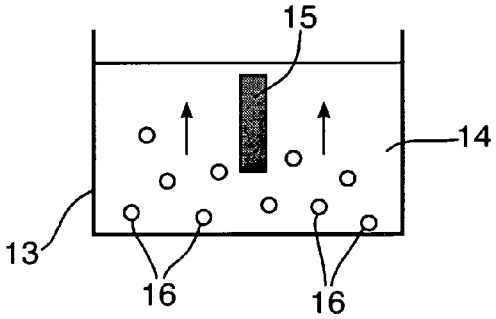
FIG. 2 is a schematic cross section of a first embodiment of a dip tank in accordance with the present invention.

As indicated above, adjustment of the leaching solution effect in a tank combination can take a number of forms. Embodiments of such adjustment are described below with respect to FIGS. 2 to 5. In FIG. 2 depicting a cross-section of a first embodiment of a dip tank 13 in accordance with the present invention, it will be noted that a core 15 is immersed in a leaching solution 14. As described previously, this leaching solution 14 will generally have been "calibrated" in a pre-adjustment tank in terms of temperature and other factors for consistency with other dip tanks (not shown) in a tank combination or at least adjusted for consistency between leaching solutions utilised with respect to each core 15 presented in a number of cores in a batch. In the first embodiment depicted in FIG. 2, the leaching solution 14 is agitated in order to homogenise the leaching solution 15 throughout the bulk within the tank 13. In such circumstances, bubbles 16 are generated by an appropriate mechanism in order to create agitation within the leaching fluid 14. These bubbles stir the fluid 14 about and into the core 15. In such circumstances, the fluid 14 is not stagnant and the leaching effect therefore promoted. It will be understood that for consistency the bubbles 16 are generated either uniformly for each core 15 presented or agitation through the bubbles may be increased or decreased dependent upon the saturation age of the leaching solution 14 or its temperature or other physical factors in order to equalise the leaching effect across all cores 15 of a number of cores in a batch.

Figure 3:
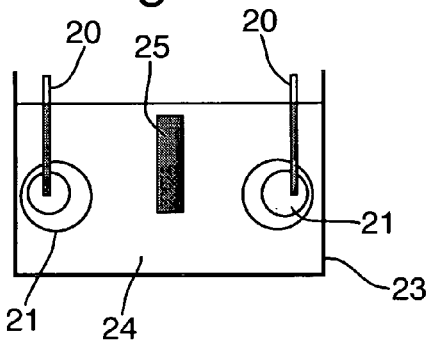
FIG. 3 is a schematic cross section of a second embodiment of a dip tank in accordance with the present invention.

FIG. 3 illustrates a second embodiment of a dip tank 23 in accordance with the present invention. Thus, the dip tank 23 again incorporates a body of leaching fluid 24. Generally the leaching fluid or solution 24 as indicated previously will be substantially homogenised by a pre adjustment process in terms of temperature and other leaching effects for consistency across all cores 25 to be processed in a batch. In order to generate agitation within the fluid 24 in the embodiment described in FIG. 3, ultra sonic wands 20 are arranged to create sonic booms 21 which agitate the fluid or solution 24. These sonic booms 21 create fluid flow within the leaching fluid or solution 24, again facilitating the leaching process with regard to the core 25. As previously the degree of agitation created by the booms 21 can be rendered consistent for all cores 25 presented or adjusted to take account of varying physical factors with respect to the leaching solution 24 for consistency of leaching effect across all the cores 25 of a batch.

Figure 4:
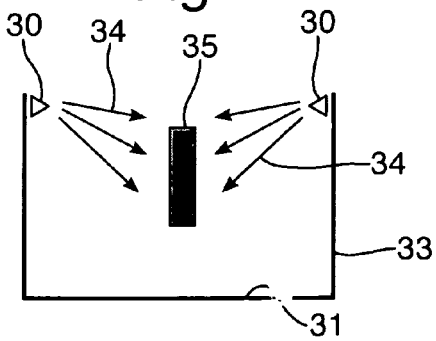
FIG. 4 is a schematic cross section of a third embodiment of a dip tank in accordance with the present invention.

FIG. 4 illustrates a third embodiment of a dip tank 33 in accordance with the present invention. In this embodiment a volume of leaching solution is sprayed by spray heads 30 towards a core 35. In such circumstances a spray suspension 34 is projected towards the core 35 such that there is a volume of leaching mist solution about the core 35. Such a leaching mist creates an even exposure of the core 35 to the leaching solution effectively in suspension about the core 35. It will be noted that by use of a spray 34, less leaching solution is used and therefore the leaching solution may be pumped directly from the homogenising and calibrating pre-adjustment tank for the bulk of the leaching fluid as described previously. In such circumstances there will be consistency between the presentations of leaching fluid to the cores 35 and therefore consistency with respect to leaching effect. The leaching solution will drip from the core 35 towards a base 31 of the dip tank 33. The collected used leaching solution will then either be regenerated for re-use via adjustment in the pre-adjustment tank as described previously in order to achieve a calibrated leaching efficiency or may be disposed of.

Figure 5:
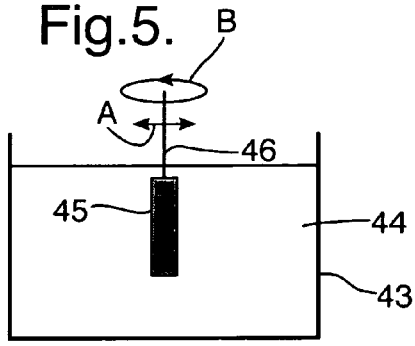
FIG. 5 is a schematic cross section of a fourth embodiment of a dip tank in accordance with the present invention.

FIG. 5 illustrates a fourth embodiment of a dip tank 43 in accordance with the present invention. Thus, the dip tank 43 incorporates the volume of leaching solution 44 with a core 45 immersed in that solution 44. The core 45 is mounted upon a hanger 46 which as described previously will automatically dip the core 45 in the solution 44 in order to leach the soluble part of the core 45 and so create a component as required. In accordance with the embodiment depicted in FIG. 5, the core is manipulated in a swish fashion. This manipulation generates fluid flow about the core 45 in order to facilitate leaching. The swishing motion may be a simple lateral side to side motion depicted by arrowheads A or a twisting motion depicted by arrowheads B or most preferably a combination.

It will be understood that all of the adjustment means provided above in terms of pre-adjustment of the leaching solution bulk as well as agitation and other factors may be combined into an operational arrangement for consistency of leaching effect upon a core over a number of cores in a batch.

I claim:

1. A method of leaching at least one core comprising a soluble part and an insoluble part with a leaching fluid, the method comprising:

providing a linear multi-stage, multi-tank arrangement in which two or more dip tanks are arranged with a volume of leaching fluid in each dip tank in which a core can be dipped; and adjusting parameters comprising concentration, volume and temperature of the leaching fluid in each dip tank with an adjustment means such that at least one parameter differs between at least two of the two or more dip tanks, wherein the adjustment means comprises a pre-adjustment tank that calibrates the leaching fluid to a known leaching efficiency so that a desired rate of leach erosion of the soluble part of each core is consistent or specifically varied over the number of cores received, each dip tank of the linear multi-stage, multi-tank arrangement having a tap supply connected directly to the pre-adjustment tank.

2. A method as claimed in claim 1 wherein the adjustment means comprises ensuring the calibrated leaching fluid is equally divided between the two or more dip tanks, each dip tank including an equal proportion of the leaching fluid and respective presentation of the cores to the number of dip tanks.

3. A method as claimed in claim 2 wherein each core is moved from dip tank to dip tank in the linear multi-stage, multi-tank arrangement.

4. A method as claimed in claim 3 wherein each core is presented to all dip tanks in sequential succession across the linear multi-stage, multi-tank arrangement.

5. A method as claimed in claim 3 wherein a core is presented to a specific group of dip tanks.

6. A method as claimed in claim 1 wherein the adjustment of the temperature of the leaching fluid is to vary the relative leach erosion efficiency of the linear multi-stage, multi-tank arrangement between cores of the number of cores presented to the linear multi-stage, multi-tank arrangement.

7. A method as claimed in claim 1 wherein the adjustment of the temperature of leaching fluid is to vary the effective leach erosion upon each core to compensate for leaching fluid saturation ageing.

8. A method as claimed in claim 1, the method further comprising:

providing the calibrated leaching fluid from the pre-adjustment tank to the two or more dip tanks through a network;

controlling parameters of the calibrated leaching fluid individually in each tank; and presenting the at least one core to the individually controlled and calibrated leaching fluid in order to remove the soluble part predictably and consistently from each core.

9. The method of claim 1, further comprising:

when a concentration of soluble material in a first dip tank reaches a specified level:

taking the first dip tank off-line to recycle the leaching fluid; and maintaining leaching operations in the remaining dip tanks.

10. The method of claim 1, further comprising regulating an in-situ concentration of soluble material in the leaching fluid in each of the dip tanks.

11. A method of concurrently leaching multiple cores with a leaching fluid, each core including a soluble part and an insoluble part, the method comprising:

disposing the cores in multiple tanks such that each tank houses one core;

providing leaching fluid to the tanks so as to expose the cores to the leaching fluid; and adjusting a volume and a temperature of the leaching fluid in each tank with a pre-adjustment tank such that at least one of volume and temperature differs between at least two tanks, wherein the pre-adjustment tank calibrates the leaching fluid to a known leaching efficiency so that a desired rate of leach erosion of the soluble part of each core is consistent or specifically varied over the number of cores received, each tank having a tap supply connected directly to the pre-adjustment tank.

* * * * *